United States Patent [19]

Nakamura et al.

[11] Patent Number: 4,472,604

[45] Date of Patent: Sep. 18, 1984

[54] PLANAR TYPE ELECTRO-ACOUSTIC TRANSDUCER AND PROCESS FOR MANUFACTURING SAME

[75] Inventors: Akira Nakamura, Shizuoka; Takao Nakaya, Hamamatsu, both of Japan

[73] Assignee: Nippon Gakki Seizo Kabushiki Kaisha, Hamamatsu, Japan

[21] Appl. No.: 240,134

[22] Filed: Mar. 3, 1981

[30] Foreign Application Priority Data

Mar. 8, 1980 [JP] Japan ..... 55-29475
Mar. 8, 1980 [JP] Japan ..... 55-30133[U]
Mar. 13, 1980 [JP] Japan ..... 55-31795[U]

[51] Int. Cl.[3] ..... H04R 9/04

[52] U.S. Cl. ..... 179/115.5 R; 179/115.5 ES; 179/115.5 PC; 179/115.5 VC; 179/181 R; 181/163; 181/171

[58] Field of Search ..... 179/115.5 R, 115.5 VC, 179/181 R, 115.5 ES, 115.5 PC; 181/164, 165, 171, 163, 144, 157, 173; 29/594

[56] References Cited

U.S. PATENT DOCUMENTS 2,864,155 12/1958 Willson ..... 29/594
4,322,583 3/1982 Maeda ..... 179/115.5 VC

FOREIGN PATENT DOCUMENTS 0143625 11/1979 Japan ..... 29/594

*Primary Examiner*—Benjamin R. Fuller
*Attorney, Agent, or Firm*—Spensley Horn Jubas & Lubitz

[57] ABSTRACT

A planar type electro-acoustic transducer having a disk-like inner diaphragm member to the top end inner side of a voice coil bobbin, and having an annular outer diaphragm member concentric with said inner diaphragm member and conjugated to the top end outer side of the voice coil bobbin, in such way that these two diaphragm members jointly constitute a single planar type diaphragm. This arrangement increases the conjugation strength of the diaphragm members to the voice coil bobbin and also enables a new manufacturing process for the transducer in which the diaphragm and the coil bobbin are easily centered.

10 Claims, 17 Drawing Figures

PLANAR TYPE ELECTRO-ACOUSTIC TRANSDUCER AND PROCESS FOR MANUFACTURING SAME

BACKGROUND OF THE INVENTION (a) Field of the invention:

The present invention relates to an electro-acoustic transducer of the so-called electro-dynamic type for use in, for example, loudspeakers, earphones and microphones, and more particularly it pertains to an electro-acoustic transducer using a planar type diaphragm.

(b) Description of the prior art:

In the past, diaphragms for electro-acoustic transducers as loudspeakers have been formed with such planar type diaphragms as shown in FIG. 1. This diaphragm 1 is constructed into honeycomb structure comprising a honeycomb core 2 formed in planar shape and skin members 3 and 4 each being made of a thin film of material such as fiber-reinforced plastics (FRP) or aluminum (Al) which is applied on each side of a honeycomb core 2. This honeycomb structure has such prominent features as: being light in weight, having a large flexural rigidity, being able to eliminate peak dip of frequency characteristic due to cavity effect which tends to produce in cone type diaphragms, as well as being able to suppress partial vibrations of lower degrees of modes by designing so as to drive the node of a critical partial vibration mode, to thereby issure that the high frequency portion of the reproduced frequency range can be broadened.

More particularly, in the planar diaphragm 1, there are present such partial vibration modes as shown in FIG. 2. Here, the respective numerals in parentheses shown in FIG. 2 represent numbers of the respective degrees of partial vibration modes. For Example, in case a voice coil bobbin 6 is bonded to the node 5 of the second degree resonance mode, and the diaphragm 1 is driven at this node 5, it is possible to suppress as far as the seven degree resonance mode shown in FIG. 2. Therefore, the high frequency region of the reproduced frequency range is broadened.

However, in the known diaphragm 1 of this type, the voice coil bobbin 6 has large diameter to match the increased outer diameter of the diaphragm 1. Thus, there have been the inconveniences that the transducer per se has become large in size, leading to an increase in the manufacturing cost, as well as the drawback that the bobbin 6 has tended to develop mechanical distortions so that the bobbin would contact the magnetic circuit. Also, as shown in an enlarged scale in FIG. 3, the voice coil bobbin 6 has its upper end face bonded integrally to the lower side of the diaphragm 1 by a bonding agent 7 to provide the state that said upper end face of the bobbin 6 is in contact with the lower side of the diaphragm. Thus, the area of contact between the two members is small and accordingly a sufficient strength of bonding cannot be obtained. For this reason, there have been the inconveniences that the diaphragm 1 becomes detached from the voice coil bobbin 6 so that the bobbin 6 comes off due to, for example, degradation of adhesiveness of the bonding agent 7 resulting from use for an extended period of time or to a large output performance.

In view of the foregoing inconveniences of the prior art, there have been proposed of late such electro-acoustic transducer as shown in FIG. 4 which is intended to solve these inconveniences. This recently proposed transducer arrangement is such that a voice coil bobbin 8 having a reduced diameter is coupled to a diaphragm 1 via a conical-shaped drive cone 9 made of such material as aluminum foil. This known structure, however, has the drawbacks such that the drive cone 9 becomes flexed during the operation of the transducer so that it is unable to perform good driving of the diaphragm 1, and also that owing to the small bonding strength of the portion of the drive cone 7 at which the cone is in contact with the diaphragm 1, it is not possible to perfectly eliminate the coming off of the voice coil bobbin 6 from the diaphragm.

Also, in the prior art, the known electro-acoustic transducer as shown in FIG. 4 as an example, has been assembled by constructing a vibration system assembly A comprising, as shown in FIG. 5, a diaphragm 1, a voice coil bobbin 8, a voice coil 10, a drive cone 9, an edge member 11 and a damper 12, and, separately from the assembly A, an outer magnet type magnetic circuit assembly B comprising a pole piece 13, a magnet 14, a yoke plate 15 and a frame 16. Thereafter, the vibration system assembly A is attached to the magnetic circuit assembly B, for completion. During this construction, the vibration system assembly A is secured to the frame 16 after being centered of its position relative to the frame 16, and the peripheral edge portion of the diaphragm 1 is conjugated to the open end edge of the frame 16 via its edge portion 11 and a gasket not shown.

However, in such known manufacturing process as stated above, the vibration system assembly A is inserted into the mangetic circuit assembly B while centering or aligning the axes of the diaphragm 1 and of the voice coil bobbin 8 simultaneously. Thus, this centering is not performed with good accuracy. As a result, there is left uneven portions of clearance between the voice coil 10 and the yoke plate 15. In the worst case, these two members have portions at which they contact each other.

SUMMARY OF THE INVENTION

It is, therefore, a primary object of the present invention to provide an electro-acoustic transducer in which its voice coil bobbin can be coupled to the planar type diaphragm with sufficient mechanical strength.

Another object of the present invention is to provide an electro-acoustic transducer of the type as described above, in which, owing to the improved coupling strength between the diaphragm and the voice coil bobbin, there occurs substrantially no degradation in the coupling state between the diaphragm and the voice coil bobbin during the use for an extended period of time or due to large output performance.

Still another object of the present invention is to provide an electro-acoustic transducer of the type as described above, in which, owing to the employment of a supporting rib for supporting a voice coil bobbin of a reduced diameter and a diaphragm, it is possible to use a compact size magnetic circuit which is small relative to the size of the diaphragm.

Yet another object of the present invention is to provide a process for manufacturing an electro-acoustic transducer of the type as described above, which allows an accurate centering of component members during the assembling of the transducer.

BRIEF DESCRIPTION OF THE DRAWINGS

Like parts are indicated by like reference numerals and symbols throughout the drawings for the sake of simplicity.

DETAILED DESCRIPTION OF THE PREFERRED EMBODIMENTS

Figure 6:
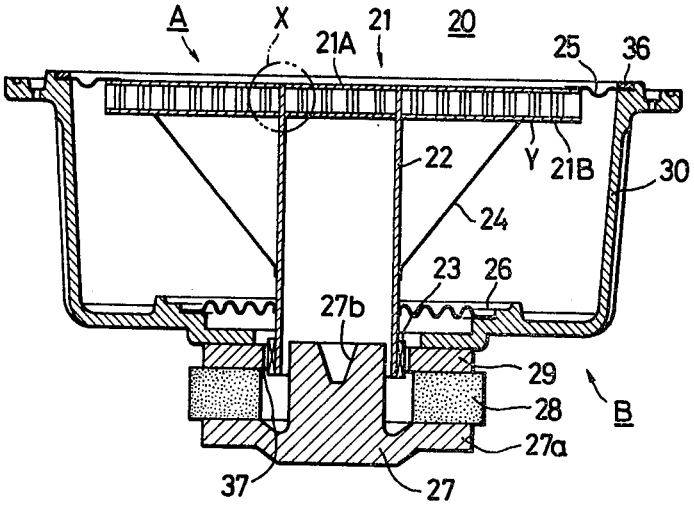
FIG. 6 is a diagrammatic vertical sectional view of an electro-acoustic transducer representing an embodiment of the present invention.

FIG. 6 is an illustration showing an embodiment of the electro-acoustic transducer according to the present invention. The electro-acoustic transducer shown generally at 20 is constructed with a vibration system assembly A comprising a diaphragm 21 having a honeycomb structure, a voice coil bobbin 22, a voice coil 23, a supporting rib 24, an edge member 25 and a damper 26, and an outer magnet type magnetic circuit assembly B comprising a flange 27*a*, a pole piece 27 having a positioning hole 27*b*, a magnet 28, a yoke plate 29 and a frame 30.

The magnetic circuit assembly B is constructed by placing, on top of the flange 27*a* of the pole piece 27, a magnet 28, a yoke plate 29 and a frame 30 one upon another in this order, and by coupling these members integrally by the use of a bonding agent. A circular magnetic gap is formed between the yoke plate 29 and an upper portion of the pole piece 27.

Figure 1:
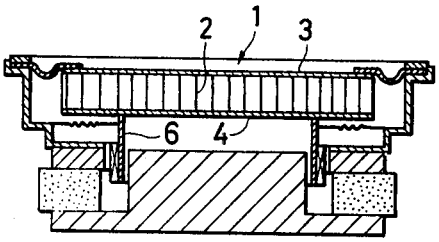
FIG. 1 PRIOR ART
FIG. 1 is a diagrammatic vertical sectional view of a known electro-acoustic transducer having a planar type diaphragm.
Figure 2:
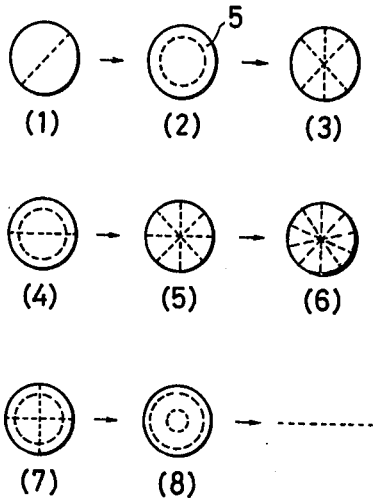
FIG. 2 is an illustration showing partial vibration modes developed in the planar type diaphragm.

The voice coil bobbin 22 is formed into a cylindrical configuration by the use of, for example, a polyimide laminated film. The diameter of this voice coil bobbin 22 is set so that this diameter is sufficiently smaller than the diameter of the node of a partial vibration mode developing concentrically when the diaphragm 21 is driven at its center. For example, the bobbin diameter is enough smaller than that of the node of the second degree resonance mode shown in FIG. 2, i.e. the stationary point of the diaphragm when this diaphragm is undergoing partial vibration in a certain degree resonance mode.

Figure 7:
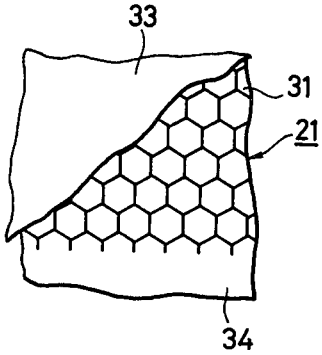
FIG. 7 is a diagrammatic plan view, partially broken away, of a diaphragm employed in the elector-acoustic transducer shown in FIG. 6.
Figure 8:
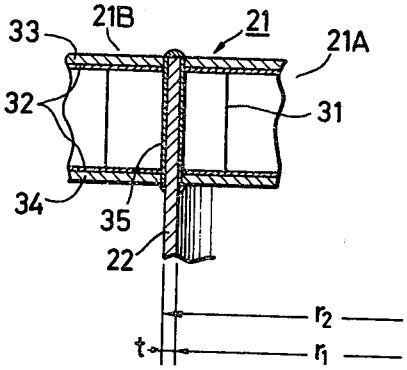
FIG. 8 is a diagrammatic enlarged view of the encircled portion indicated by X of the electro-acoustic transducer shown in FIG. 6.

The diaphragm 21 is constructed, as shown in FIGS. 7 and 8, in the same way as in the conventional, into a honeycomb structure by the use of a honeycomb core 31 which is made of an aluminum foil, and skin members 33 and 34 each being made of a thin film of a material such as FRP or aluminum and is applied onto the respective sides of the honeycomb core 31 by a bonding agent or a bonding film 32.

Figure 9A:
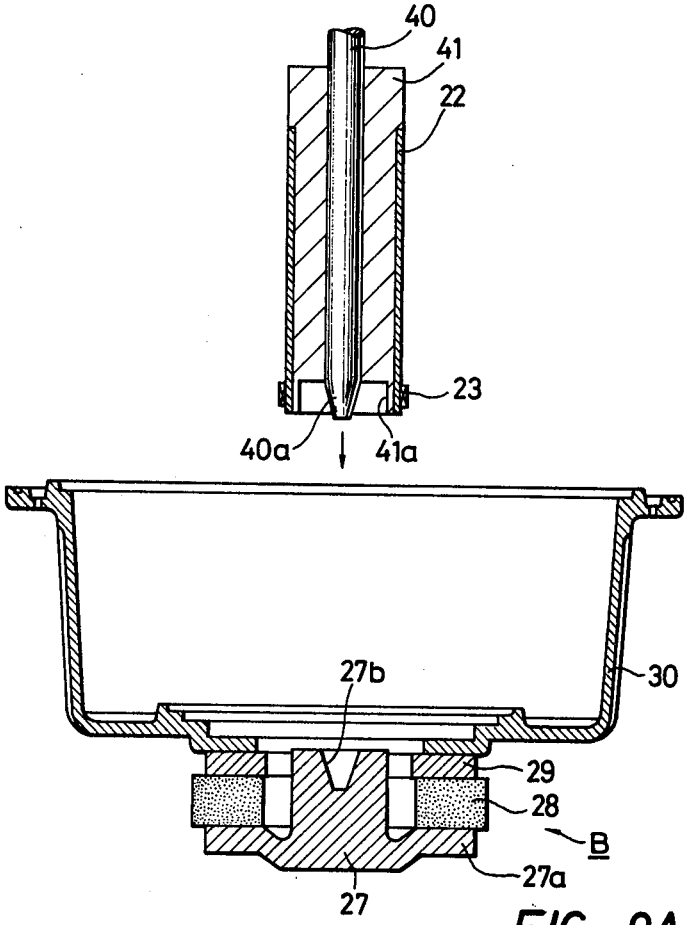
FIGS. 9A to 9E are diagrammatic illustration of an embodiment of the manufacturing steps of the electro-acoustic transducer shown in FIG. 6.
Figure 9B:
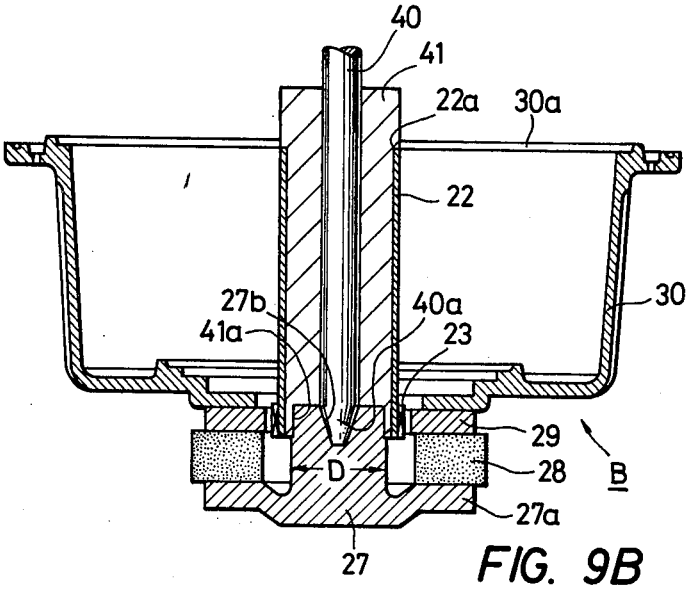
Figure 9C:
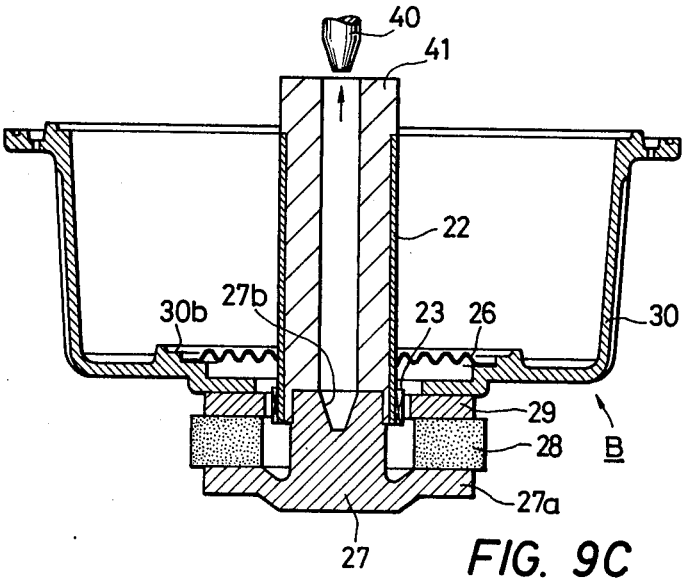
Figure 9D:
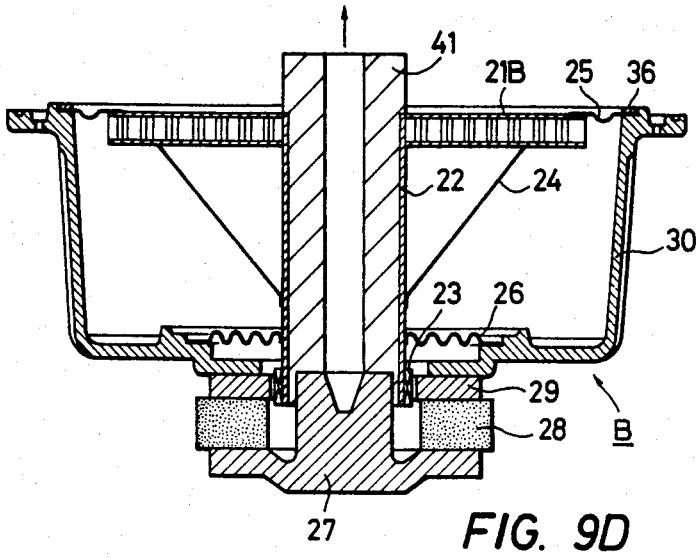

Unlike the known diaphragm made of a continuous single board, the above-mentioned diaphragm 21 is formed with a disk-like inner diaphragm member 21*a* and an outer annular diaphragm member 21*b* by being divided at the boundary at which the voice coil bobbin 22 is joined to the diaphragm 21 (See FIG. 9D). The inner diaphragm member 21*a* has a radius $r_1$ of its outer circumference, and the outer diaphragm member 21*b* has a radius $r_2$ of its inner circumference. These two diaphragm members 21*a* and 21*b* are formed in such way that the difference between $r_{2-r1}$ is substantially equal to the thickness t of the wall of the voice coil bobbin 22. The upper end portion of the voice coil bobbin 22 is arranged to pass through the honeycomb core 31 to fit in the gap formed by the difference $r_2-r_1$ when the two diaphragm members 21*a* and 21*b* are positioned flush and concentrically to each other, and in this state the upper end portion of the voice coil bobbin 22 is bonded to both diaphragm members 21*a* and 21*b* via a bonding agent such as of the epoxy group or nylon group.

The outer diaphragm member 21*b* is vibratably secured to the peripheral edge of the opening of the frame 30 by a gasket 36 via the edge member 25, and concurrently this outer diaphragm member 21*b* is coupled to the voice coil bobbin 22 via the cone-shaped supporting rib 24. This supporting rib 24 is formed with such material as aluminum foil, and its upper open end edge is bonded, by a bonding agent, to the lower side of the outer diaphragm 21*b* at such site that serves as the node of said second degree resonance mode of the diaphragm 21, and the lower open end edge thereof is bonded to the external circumferential surface of the voice coil bobbin 22.

Also, the intermediate portion of the voice coil bobbin 22 is secured to the frame 30 via the damper 26, and that part of its lower end portion around which is wound the voice coil 23 is inserted within the magnetic gap 37 which is formed between the pole piece 27 and the yoke plate 29. Accordingly, when a signal current is caused to flow through this voice coil 23, the voice coil bobbin 22 will undergo vertical movements in accordance with this current to cause the diaphragm 21 to vibrate.

From the foregoing description, it will be appreciated that the abovesaid embodiment of the electro-acoustic transducer allows its voice coil bobbin 22 to have a reduced diameter, and thanks to this reduced diameter, the magnetic circuit portion may be made into a compact size, resulting in not only the materialization of light weight of the transducer as a whole, but also the amount of material of voice coil 23 may be saved.

Also, when the diaphragm 21 is driven by the voice coil bobbin 22, the site of the diaphragm which is indicated at Y in FIG. 6 and which serves as the node of the second degree resonance mode thereof is driven by the supporting rib 24. Thus, it is possible to eliminate as far as the seven degree resonance mode, and accordingly the high frequency portion of the reproduced frequency range can be widened.

Furthermore, as stated above, the voice coil bobbin 22 is bonded to both the inner diaphragm member 21*a* and the outer diaphragm member 21*b* after passing through the honeycomb core 31. Thus, it has a markedly increased area of conjugation with the diaphragm 21, and accordingly there is obtained a more firm strength of conjunction. As such, the voice coil bobbin 22 and the inner diaphragm member 21*a* are prevented from detachment of coming off from each other due to use for an extended period of time of during a large output operation, so that the span of life of the electro-acoustic transducer 20 is improved.

Next, description will be made of an embodiment of assembling process of the electro-acoustic transducer 20 shown in FIG. 6, by referring to FIGS. 9A to 9E. As shown in FIG. 9A, the magnetic circuit assembly B is constructed, as stated previously, by laminating a magnet 28, a yoke plate 29 and a frame 30 on top of the flange 27*a* of the pole piece 27 by the use of an appropriate jig in such way that these members are placed one upon another concentrically to each other, and by bonding them together integrally. In this embodiment, the hole 27*b* for a positioning pin 40 which is formed in the upper central portion of the pole piece 27 is formed into a conical shape. The attachment of the vibration system components to the magnetic circuit assembly B is performed in the below-mentioned steps.

The voice coil bobbin 22 having a voice coil 23 wound around its lower end portion is fit onto a cylindrical holding jig 41 which, in turn, is mounted on a positioning pin 40. This voice coil bobbin 22, along with said positioning pin 40 and the holding jig 41, is inserted onto the magnetic circuit assembly B in a manner as shown in FIG. 9B. The bottom portion 40*a* of the positioning pin 40 is formed into a conical shape to comply with the conical shape of the hole 27*b* of the pole piece 27. This bottom portion 40*a* of the positioning pin 40 engagingly fits into the hole 27*b*. Concurrently therewith, the opening 41*a* which is formed at the bottom face of the holding jig 41 engages the pole piece 27. Whereupon, the axes of both the pole piece 27 and the positioning pin 40 are aligned, and the centering of the voice coil bobbin 22 is accomplished. As a result, there is formed a uniform magnetic gap between the voice coil bobbin 22 and the pole piece 27 and between the coil bobbin 22 and the yoke plate 29 throughout the circumferences thereof. It will be needless to say that the opening 41*a* of the jig 41 has an inner diameter which is set substantially equal to the outer diameter D of the pole piece 27. Also, the upper end surface of the voice coil bobbin 22 is flush with the open end face 30*a* of the frame 30 in a single same plane.

Upon completion of the attachment of the voice coil bobbin 22, the positioning pin 40 is withdrawn out of the holding jig 41, and the damper 26 is mounted on the voice coil bobbin 22, and its inner circumferential face and its outer peripheral portion are bonded to the bobbin 22 and to the damper-attachment seat 30*b* of the frame 30. FIG. 9C shows this state.

Next, the step will be switched to the assembling of the diaphragm 21 having a honeycomb structure. As stated above, this diaphragm 21 is different from the known diaphragm having a single plate structure, and is divided into two concentric sections, i.e. it consists of an inner diaphragm member 21*a* and an outer diaphragm member 21*b*. The inner diameter of the outer diaphragm member 21*b* is set substantially equal to the outer diameter of the voice coil bobbin 22, and the diameter of the inner diaphragm member 21*a* is set substantially equal to the inner diameter of the bobbin 22. The attachment of the diaphragm 21 having such divided sections is started with the attachment of the outer diaphragm member 21*b* in a manner as shown in FIG. 9D. In such case, however, to the bottom side of the outer diaphragm member 21*b* is preliminarily bonded the supporting rib 24, and to the outer peripheral edge thereof is preliminarily attached the edge member 25. The lower end portion of this supporting rib 24 is bonded to the voice coil bobbin 22, and the edge member 25 is bonded to the open end edge of the frame 30. The outer diaphragm member 21*b* which is mounted on the voice coil bobbin 22 is bonded to this bobbin 22. Then, a gasket 36 is attached to the open end edge of the frame 30 via the edge member 25, and the holding jig 41 is withdrawn out of the voice coil bobbin 22.

Figure 9E:
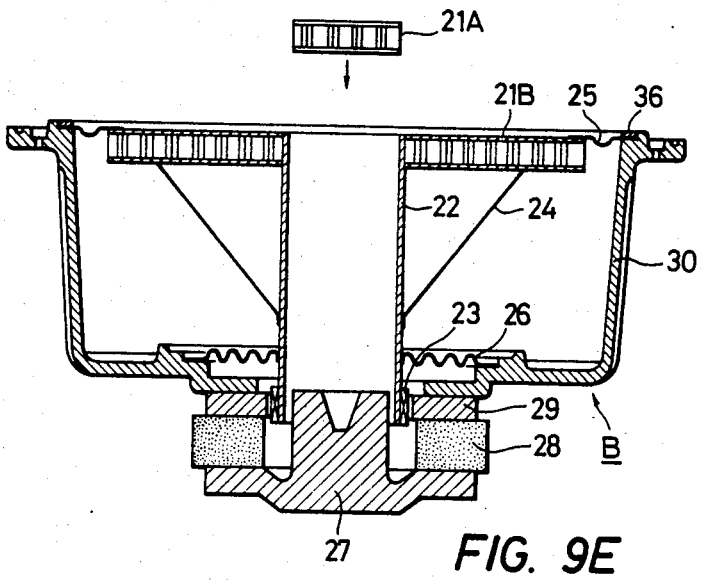

On the other hand, the inner diaphragm member 21*a* is inserted into the upper open end portion of the voice coil bobbin 22 as shown in FIG. 9E, and its periperal edge is bonded to the inner wall of the bobbin 22. In such instance, the inner diaphragm member 21*a* is bonded to the wall of the voice coil bobbin 22 in such way that it is positioned in a same plane with the outer diaphragm member 21*b*, and these two diaphragm members 21*a* and 21*b* jointly constitute a diaphragm 21.

With this, the attachment of the vibration system assembly is complete, and there is now fabricated an electro-acoustic transducer 20 as shown in FIG. 6.

According to the manufacturing process described above, the diaphragm is attached to a centered voice coil bobbin 22. Thus, the centering of the diaphragm can be performed with a very high precision. Also, the magnetic gap between the voice coil bobbin 22 and the pole piece 27 and the magnetic gap between the voice coil bobbin 22 and the yoke plate 29 can be set uniform. Therefore, an electro-acoustic transducer having a uniform quality can be manufactured. Furthermore, the centering can be performed by the use of a simple jig, so that the assembling operation can be performed easily.

Figure 10A:
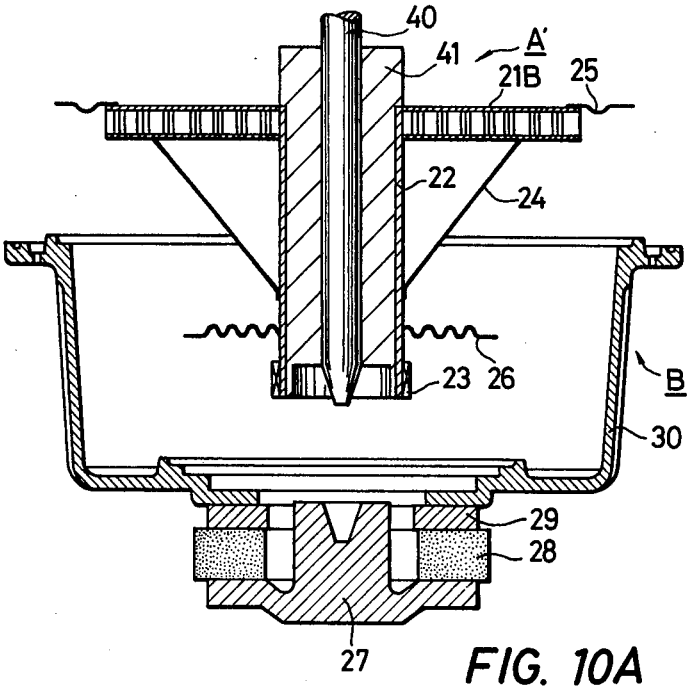
FIGS. 10A to 10C are diagrammatic illustration of another embodiment of the manufacturing steps of the electro-acoustic transducer shown in FIG. 6.
Figure 10B:
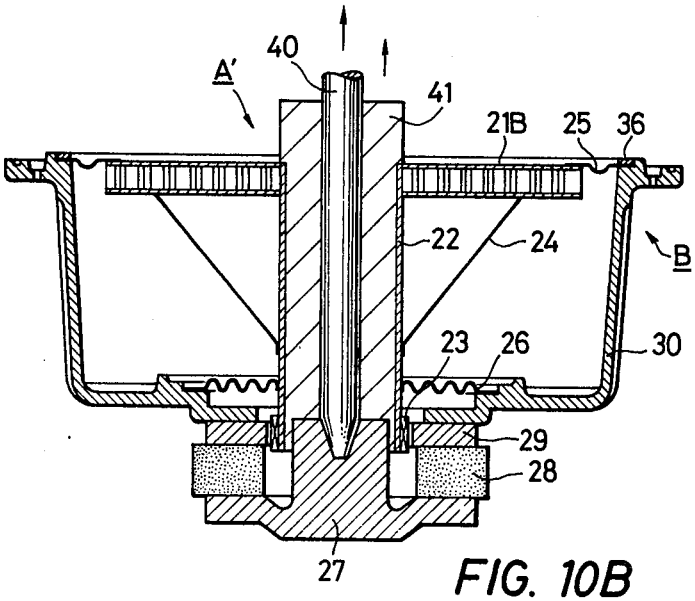
Figure 10C:
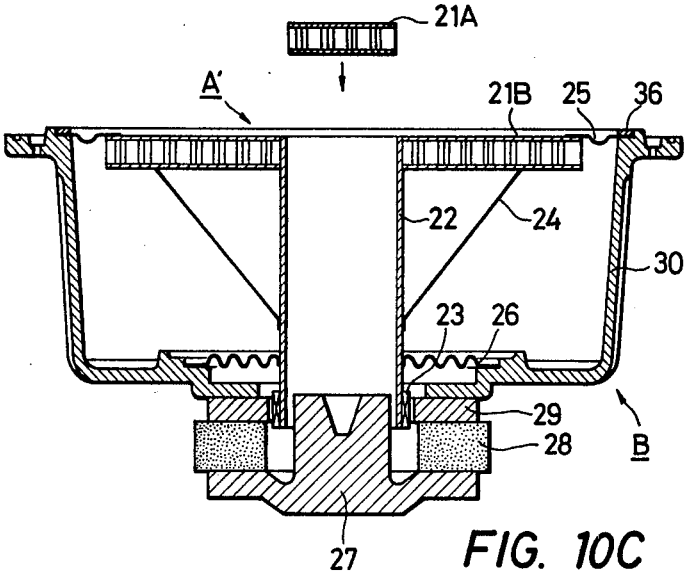

FIGS. 10A to 10C show assembling steps representing another embodiment of the manufacturing process. In this embodiment, a vibration system assembly A′ is fabricated preliminarily with a voice coil bobbin 22, a voice coil 23, a supporting rib 24, an edge member 25, a damper 26 and an outer diaphragm member 21*b* (see FIG. 10A). This assembly A′ along with a positioning pin 40 and a holding jig 41, is inserted into a magnetic circuit assembly B in the same manner as that for the preceding embodiment, to thereby perform the centering of the diaphragm system assembly A′. Upon completion of this centering step, there is performed the bonding of the edge member 25 and the damper 26 onto the frame 30 as well as the attachment of the gasket 36. FIG. 10B shows this process. Thereafter, the positioning pin 40 and the holding jig 41 are withdrawn out of the voice coil bobbin 22. Then, as in the preceding embodiment, the inner diaphragm member 21*a* is inserted and bonded within the voice coil bobbin 22 as shown in FIG. 10C. With this, the fabrication of the vibration system assembly is complete, and there is now provided an electro-acoustic transducer as shown in FIG. 6.

In this second embodiment also, it will be appreciated that the fabrication of the diaphragm is easy, and a high-precision centering of same can be performed similar to the preceding embodiment.

Figure 3:
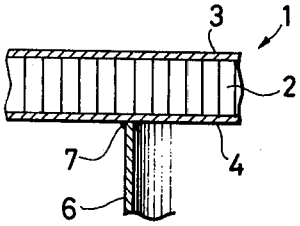
FIG. 3 PRIOR ART
FIG. 3 is a diagrammatic sectional view of an essential portion, showing the coupling structure of a diaphragm and a voice coil bobbin in the known electro-acoustic transducer shown in FIG. 1.
Figure 4:
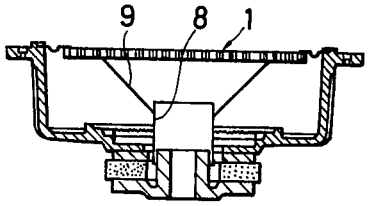
FIG. 4 PRIOR ART
FIG. 4 is a diagrammatic vertical sectional view of another known electro-acoustic transducer having a planar type diaphragm.
Figure 5:
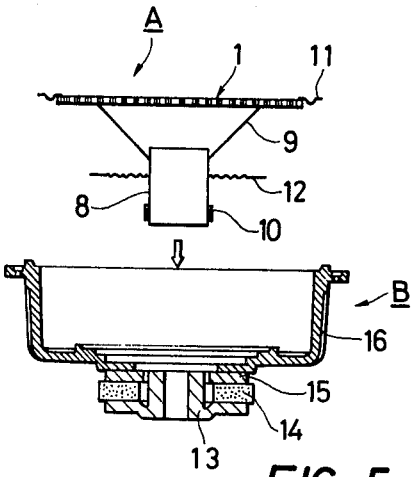
FIG. 5 PRIOR ART
FIG. 5 is a diagrammatic exploded vertical sectional view, for explaining the assembling of the electro-acoustic transducer shown in FIG. 4.

Description has been made of the instances wherein the inner diaphragm member 21*a* is bonded and secured to the inner wall of the voice coil bobbin 22. The attachment of this inner diaphragm member 21*a* is not limited to this manner. Needless to say, it may be bonded to the outer diaphragm member 21*b* and to the voice coil bobbin 22. In such instance, however, there is the necessity that the outer diameter of the inner diaphragm member 21*a* is set substantially equal to the inner diameter of the outer diaphragm member 21*b*, and that the voice coil bobbin 22 has a reduced length or height so that its upper end face is flush with the lower side skin member 34 of the outer diaphragm member 21*b* as shown in FIG. 3.

Figure 11:
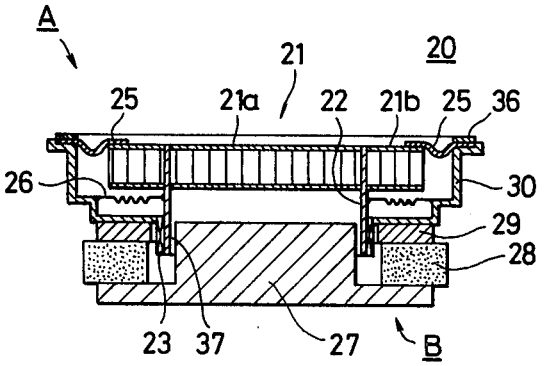
FIG. 11 is a diagrammatic vertical sectional view of an electro-acoustic transducer representing another embodiment of the present invention.

FIG. 11 shows another embodiment of the electro-acoustic transducer according to the present invention. In this embodiment, the voice coil bobbin 22 has a diameter set equal to the diameter of the node of the second degree resonance mode of the diaphragm 21 to thereby eliminate the provision of the supporting rib 24 employed in the preceding embodiment. Other parts and structure are same to those of the electro-acoustic transducer shown in FIG. 6, so that detailed explanation of the component indicated by like reference numerals and symbols is omitted.

What is claimed is:

1. An electro-acoustic transducer, comprising:

a vibration system assembly including:

a planar type diaphragm concentrically divided into an inner diaphragm member and a ring-like outer diaphragm member; and a voice coil bobbin having said inner diaphragm member bonded to an inner side thereof by a bonding agent and having said outer diaphragm member bonded to an outer side thereof by a bonding agent and having a voice coil attached therearound;

said inner diaphragm member having its outer diameter substantially equal to the inner diameter of said voice coil bobbin, and said outer diaphragm member having its inner diameter substantially equal to the outer diameter of said voice coil bobbin; and a magnetic circuit assembly including:

a frame for vibratably supporting said vibration system assembly;

a magnetic gap for receiving the voice coil; and a magnet for providing a magnetic field to said magnetic gap;

an edge member for vibratably supporting said outer member; and a damper for vibratably supporting said voice coil bobbin, said edge member and said damper each having an end fixed relative to said frame.

2. An electro-acoustic transducer according to claim 1, wherein said planar type diaphragm has a honeycomb structure comprising a honeycomb core and a skin member applied on each side thereof.

3. An electro-acoustic transducer according to claim 2, wherein said honeycomb core is formed with aluminum foil, and said skin member is formed with a thin film of material selected from fiber-reinforced plastics and aluminum.

4. An electro-acoustic transducer according to claim 1, wherein said planar type diaphragm is divided concentrically into said inner diaphragm member and said outer diaphragm member at a site thereof serving as node of second degree resonance mode thereof.

5. An electro-acoustic transducer according to claim 1, wherein said planar diaphragm is divided concentrically into said inner diaphragm member and said outer diaphragm member at a site thereof located proximal relative to a site serving as a node of second degree resonance mode thereof.

6. An electro-acoustic transducer according to claim 5, wherein said outer diaphragm member is supported by a supporting rib onto said voice coil bobbin at a site of said outer diaphragm member where said node of the second degree resonance mode of the planar diaphragm develops.

7. An electro-acoustic transducer according to claim 6, wherein said supporting rib has a cone shape formed with aluminum foil.

8. An electro-acoustic transducer according to claim 1, wherein said magnetic gap is formed by a center pole piece and yoke plate, and said magnet is sandwiched between a portion of said center pole piece and said yoke plate.

9. A diaphragm assembly for electro-acoustic transducer, comprising:

a planar honeycomb type diaphragm comprised of an inner substantially circular diaphragm portion and a separate outer annular diaphragm portion;

a tubular voice coil bobbin having a first end thereof secured to the diaphragm, wherein the inner diaphragm portion is bonded to the inside of the bobbin and the outer diaphragm portion is bonded to the outside of the bobbin; and a voice coil secured to the bobbin near and second end thereof.

10. In an electro-acoustic transducer of the type having a planar honeycomb-type diaphragm secured to a tubular voice coil bobbin, the improvement wherein the diaphragm includes an inner honeycomb portion which is bonded to and extends into the inside of an end of the bobbin and a separate annular outer honeycomb portion, the inside surface of which is bonded to the outside of the bobbin.

* * * * *